US009540207B1

(12) United States Patent
Chen

(10) Patent No.: US 9,540,207 B1
(45) Date of Patent: Jan. 10, 2017

(54) TAPE APPLICATOR HAVING EDGE FOLDING STRUCTURE

(71) Applicant: Hsiu-Man Yu Chen, Taichung (TW)

(72) Inventor: Hsiu-Man Yu Chen, Taichung (TW)

( * ) Notice: Subject to any disclaimer, the term of this patent is extended or adjusted under 35 U.S.C. 154(b) by 0 days.

(21) Appl. No.: 14/989,157

(22) Filed: Jan. 6, 2016

(51) Int. Cl.

| | |
|---|---|
| ***B32B 37/00*** | (2006.01) |
| ***B29C 65/00*** | (2006.01) |
| ***B44C 7/00*** | (2006.01) |
| ***B65H 35/00*** | (2006.01) |
| ***B65H 16/00*** | (2006.01) |
| ***B65H 37/06*** | (2006.01) |
| ***B65H 37/00*** | (2006.01) |
| *B31F 1/00* | (2006.01) |

(52) U.S. Cl.
CPC ..... *B65H 35/0073* (2013.01); *B65H 16/005* (2013.01); *B65H 35/0013* (2013.01); *B65H 35/0026* (2013.01); *B65H 37/005* (2013.01); *B65H 37/007* (2013.01); *B65H 37/06* (2013.01); *B65H 2301/45* (2013.01)

(58) Field of Classification Search
CPC ..... B65H 35/0073; B65H 35/0013; B65H 35/0026; B65H 37/005; B65H 37/007; B65H 37/06
USPC ..... 156/579, 577, 510
See application file for complete search history.

(56) References Cited

U.S. PATENT DOCUMENTS

| | | | | |
|---|---|---|---|---|
| 7,357,285 | B2 * | 4/2008 | Namekawa | B65H 35/0033 156/463 |
| 2006/0118245 | A1 * | 6/2006 | Imazeki | B65H 35/0033 156/510 |
| 2006/0175017 | A1 * | 8/2006 | Namekawa | B65H 35/0026 156/443 |
| 2016/0122151 | A1 * | 5/2016 | Vulpitta | B65H 35/0033 225/56 |
| 2016/0159604 | A1 * | 6/2016 | Vulpitta | B65H 45/22 225/66 |

* cited by examiner

*Primary Examiner* — Alex Efta
(74) *Attorney, Agent, or Firm* — Ming Chow; Sinorica, LLC

(57) ABSTRACT

A tape applicator having an edge folding structure includes a main body and an edge folding block. The edge folding block is provided with a transverse press board, a longitudinal reverse folding block, a longitudinal reverse folding reinforcement block, and a longitudinal flattening board. A distance is defined between the flattening board and the reverse folding reinforcement block. An outer side of the reverse folding block is pivotally connected with a folding post. The tape applicator has a simple structure and can be assembled easily with the folding post to be pivoted to the outer side of the reverse folding block. The tape applicator enables the tape to form a nonstick side edge exactly for the user to tear off the tape from a packing.

7 Claims, 11 Drawing Sheets

TAPE APPLICATOR HAVING EDGE FOLDING STRUCTURE

BACKGROUND OF THE INVENTION

1. Field of the Invention

The present invention relates to a sealing device, and more particularly to a tape applicator having an edge folding structure.

2. Description of the Prior Art

FIG. 1 is a perspective view of a conventional tape applicator. FIG. 2 is a schematic view of the conventional tape applicator when in use. The tape applicator comprises a main body 200. The main body 200 has a side board 210. The side board 210 is provided with a tape seat 220. The front end of the side board 210 is provided with a press roller 230 and a blade 240. The main body 200 is provided with a folding unit 250 between the press roller 230 and the tape seat 220. The folding unit 250 comprises a folding post 251, a stop block 253, an inclined block 254, a first post 255, a press block 257, and a second post 258 which are arranged in sequence in the direction of movement of a tape. A folding roller 252 is fitted on the folding post 251. The stop block 253 is disposed at the circumferential side of the folding roller 252 for pre-folding the inner side of the tape. The inclined block 254 is disposed at another side of the stop block 253 opposite the folding post 251. An upper end of the inclined block 254 has an inclined surface 2541 for folding back the inner side of the tape to form a folded side edge. The press block 257 is disposed at another side of the inclined block 254 opposite the stop block 253. The front of the press block 257 has an oblique surface 2571. The top of the press block 257 has an upper flat surface 2572. The upper flat surface 2572 is adapted to flatten the folded side edge of the tape. The first post 255 is disposed close to the upper flat surface 2572 of the press block 257. A first roller 256 is fitted on the first post 255. The first roller 256 is adapted to press the folded side edge of the tape to the upper flat surface 2572 of the press block 257, such that two adhesive sides of the tape can be adhered to each other to form a strip of nonstick side edge. The second post 258 is disposed between the press block 257 and the press roller 230. A second roller 259 is fitted on the second post 258 for delivering the tape to the press roller.

The edge folding structure of the conventional tape applicator has many parts, which is not beneficial for assembly. The folding unit 250 is unable to provide a better nonstick side edge for the tape. As a result, the tape pulled from the tape applicator is totally taped to the packing to be packed. When the user wants to open the packing, it requires much time and work to tear off the tape. Accordingly, the inventor of the present invention has devoted himself based on his many years of practical experiences to solve these problems.

SUMMARY OF THE INVENTION

The primary object of the present invention is to provide a tape applicator having an edge folding structure. The tape applicator has a simple structure and can be assembled easily. The tape applicator enables the tape to form a nonstick side edge exactly for the user to tear off the tape from a packing conveniently.

In order to achieve the aforesaid object, the tape applicator having an edge folding structure of the present invention comprises a main body and an edge folding block. The main body has a side board at one end thereof. The side board is provided with a blade, a press roller, and a tape seat.

The edge folding block comprises a base. The base has a first end and a second end positioned to the side board. The base is pivotally connected with a folding post close to the first end of the base. A gap is defined between a bottom surface of the folding post and the side board. A top surface of the base is provided with a press board and a reverse folding member. A passage is defined between the press board and the reverse folding member. One side of the reverse folding member has an inclined surface relative to the passage. The base is provided with a flattening board close to the second end of the base. The flatting board has an end portion extending towards the passage.

Thereby, through a pulling force of a tape when the tape is applied, a side edge of the tape falls into the gap and is reversely folded when the tape passes the reverse folding member. Finally, the tape is flattened by the end portion of the flattening board to form a folded side edge. The tape applicator enables the tape to form a nonstick side edge exactly for the user to tear off the tape from a packing. The folding post is pivotally connected to the outer side of the reverse folding block to complete the assembly.

DETAILED DESCRIPTION OF THE PREFERRED EMBODIMENTS

Embodiments of the present invention will now be described, by way of example only, with reference to the accompanying drawings.

Figure 1:
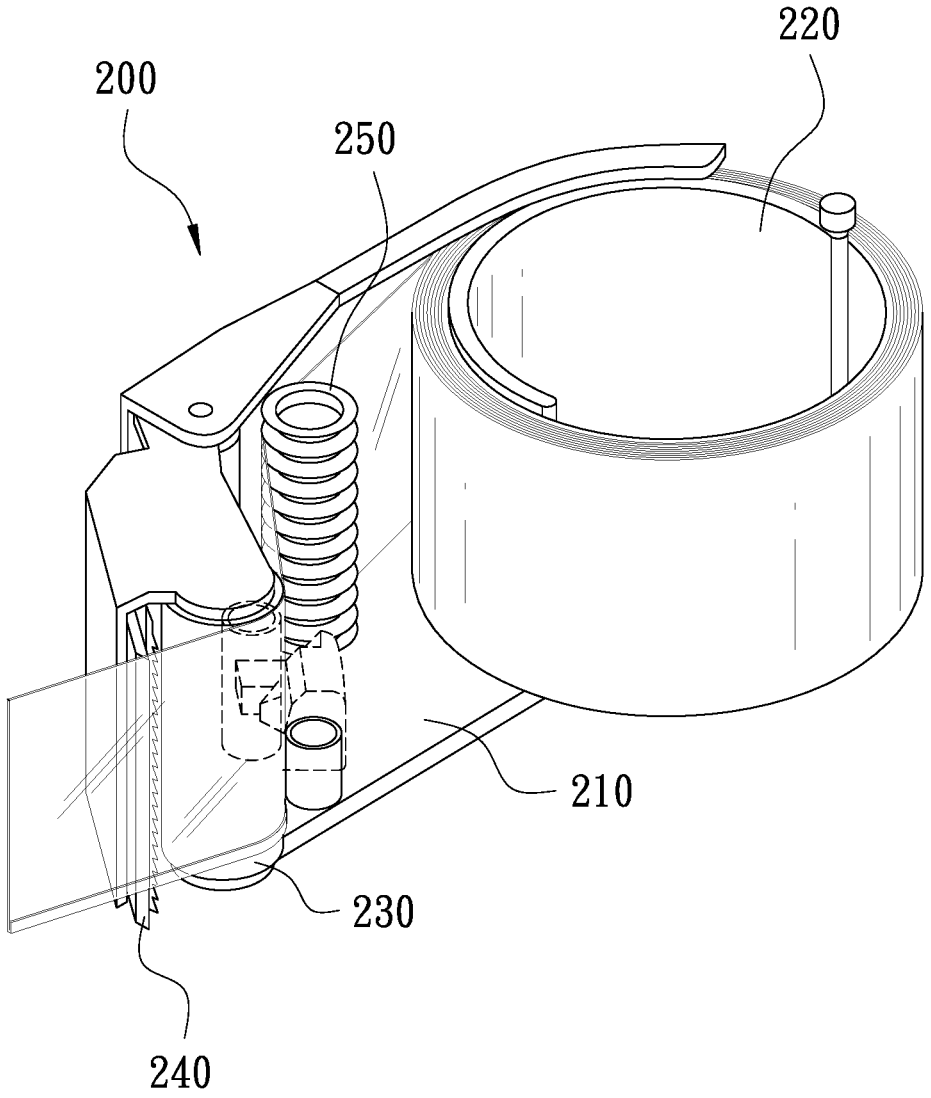
FIG. 1 PRIOR ART
FIG. 1 is a perspective view of a conventional tape applicator.
Figure 2:
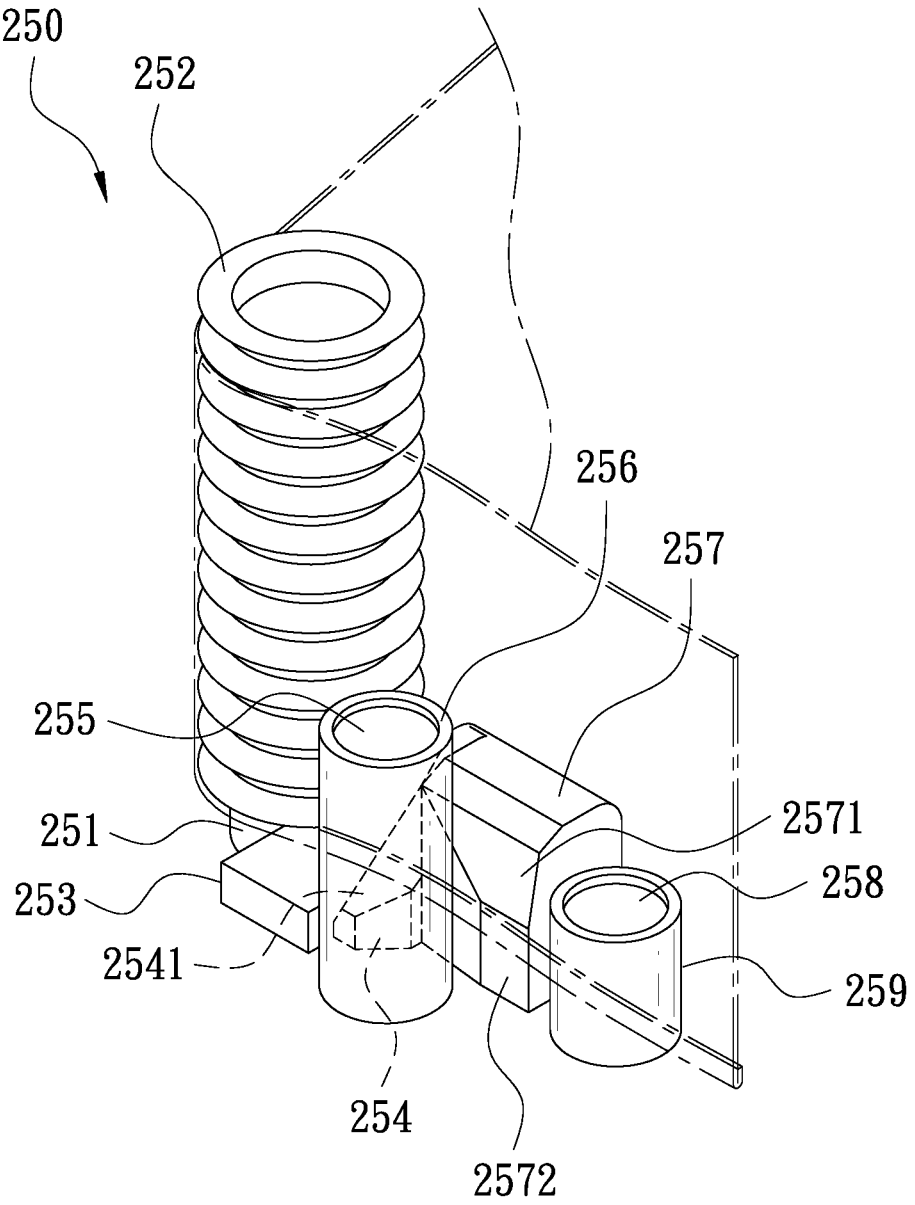
FIG. 2 PRIOR ART
FIG. 2 is a schematic view of the conventional tape applicator when in use.
Figure 3:
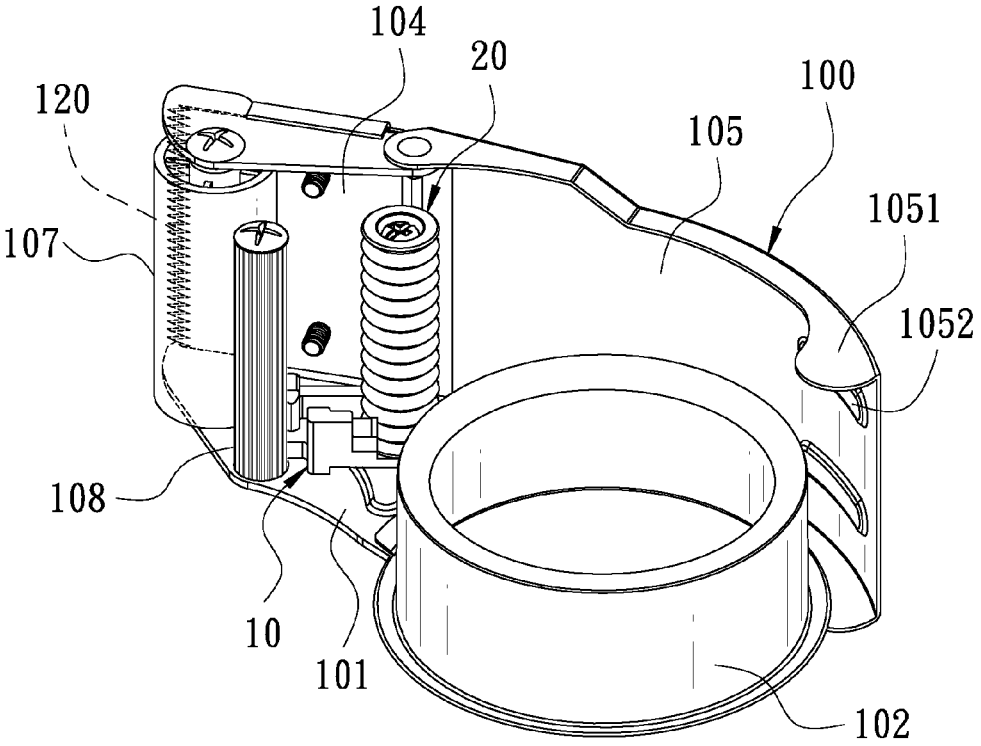
FIG. 3 is a perspective view of the present invention.
Figure 4:
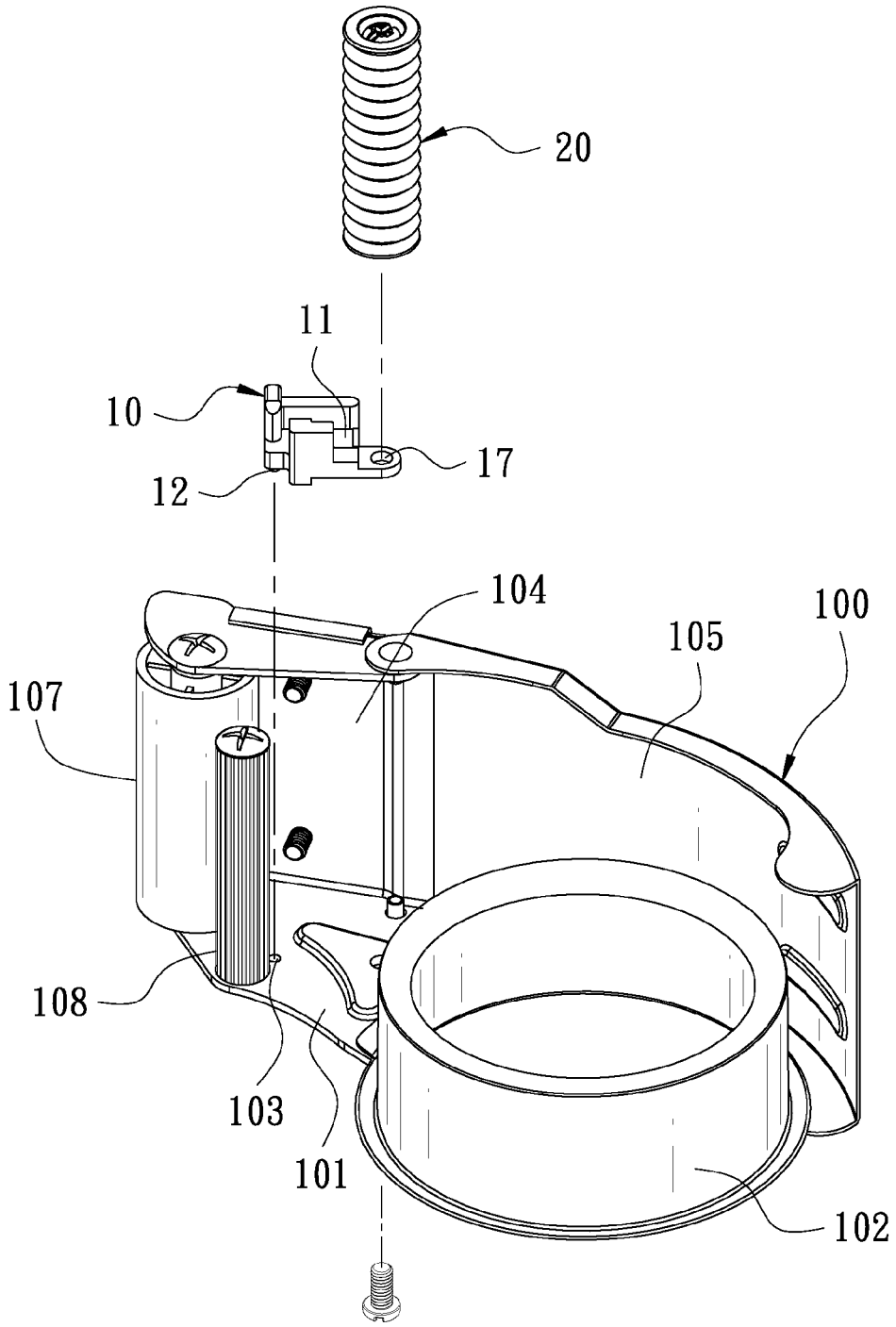
FIG. 4 is an exploded view of the present invention.

FIG. 3 is a perspective view of the present invention. FIG. 4 is an exploded view of the present invention. The present invention discloses a tape applicator having an edge folding structure. The tape applicator comprises a main body 100 and an edge folding block 10.

The main body 100 has a side board 101. The front end of the side board 101 is provided with a base 104. A blade 106 and a press roller 107 are provided between the front edge of the base 104 and the side board 101. The rear edge of the base 104 is pivotally connected with a top lid 105. The rear end of the side board 101 is provided with a tape seat 102 for placement of a tape roll. A free end of the top lid 105 extends to the tape seat 102. The periphery of the top lid 105 is provided with a protruding stop piece 1051. The free end of the top lid 105 is formed with a plurality of recesses 1052 towards the tape seat 102. The side board 101 is provided with a rolling post 108 between the press roller 107 and the tape seat 102. The side board 101 is provided with a positioning hole 103 beside the rolling post 108.

Figure 5:
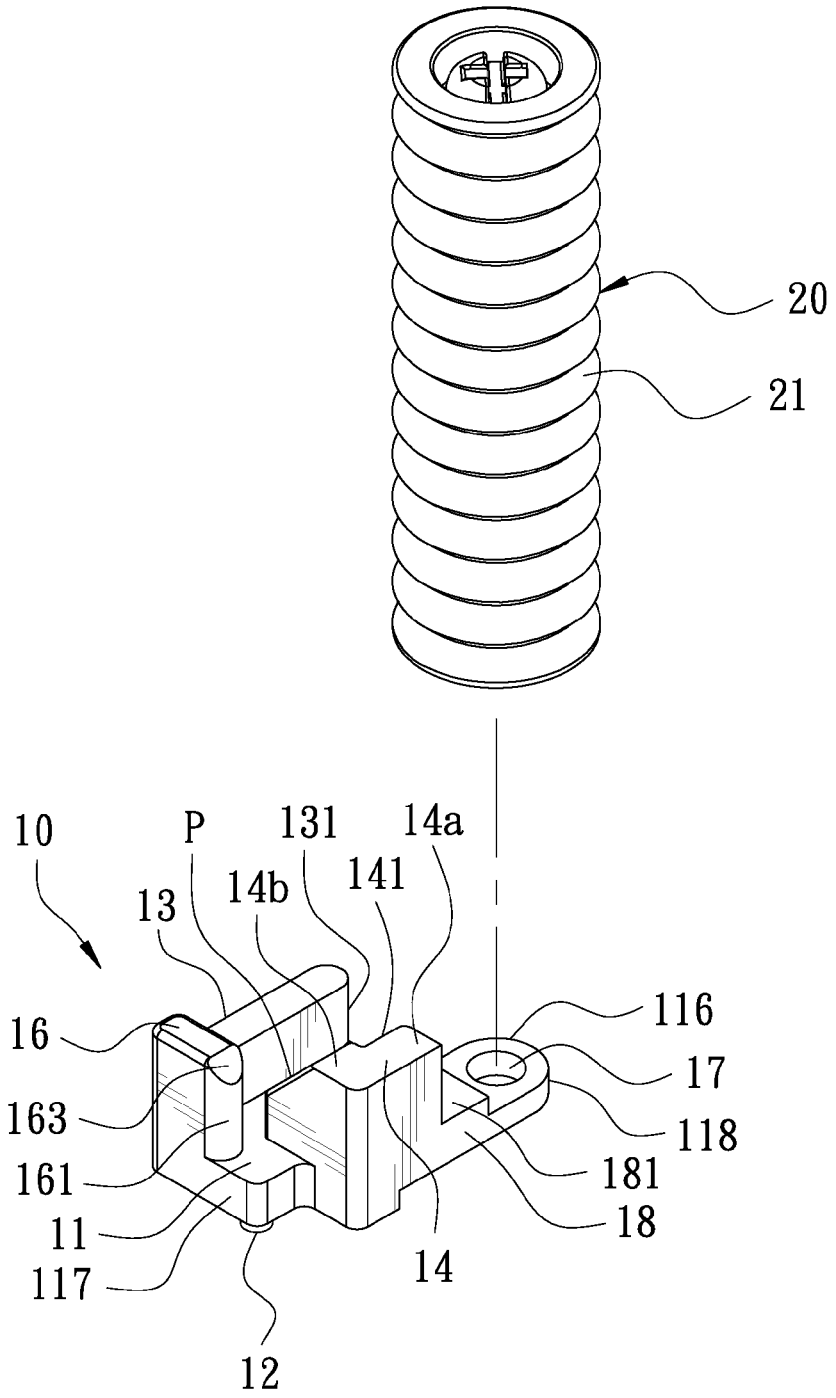
FIG. 5 is a perspective view of the edge folding block and the folding post of the present invention.
Figure 6:
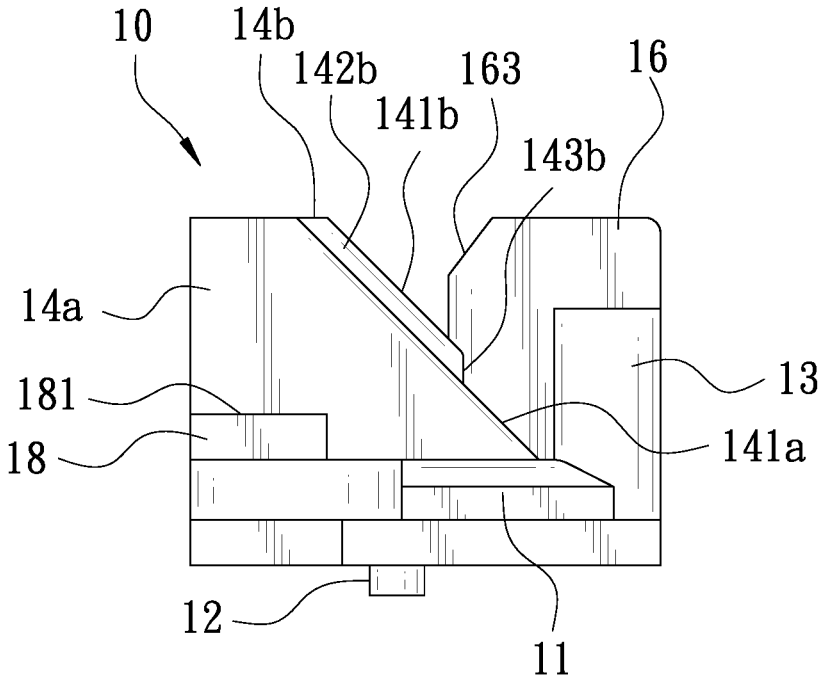
FIG. 6 is a side view of the edge folding block of the present invention.
Figure 7:
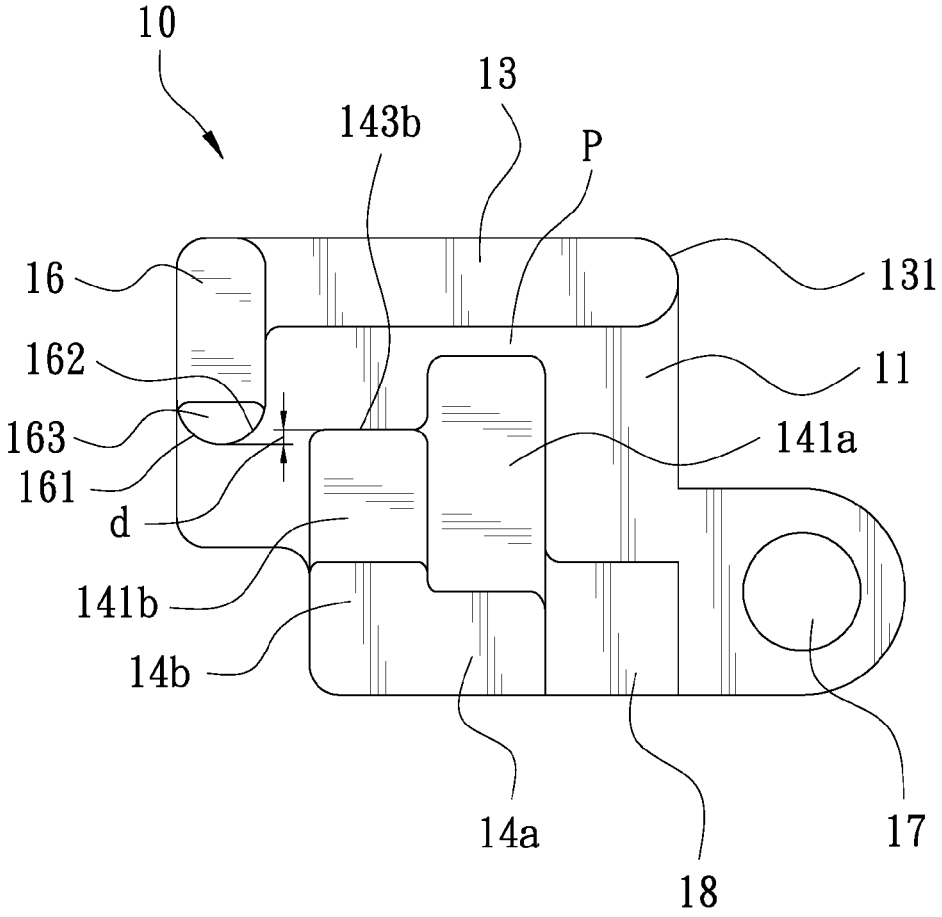
FIG. 7 is a top view of the edge folding block of the present invention.

The edge folding block 10, referring to FIG. 5 to FIG. 7, comprises a transverse base 11. The base 11 has two ends defined as a first end 116 and a second end 117. The first end 116 of the base 11 has a positioning hole 17. The base 11 is provided with a raised block 18 at one side of the positioning hole 17. The side board 101 is pivotally connected with a folding post 20 through the positioning hole 17. A circumferential wall of the folding post 20 is provided with a plurality of serrate raised portions 21. The serrate raised portions 21 are placed on a top surface 181 of the raised block 18, such that a gap is defined between a bottom surface of the folding post 20 and the side board 101 through a height difference between the top surface 181 of the raised block 18 and the side board 101. The base 11 has a first curved surface 118 close to another side of the positioning hole 17. A bottom surface of the second end 117 of the base 11 is provided with a positioning protrusion 12 relative to the positioning hole 103 of the side board 101. Through the positioning protrusion 12, the base 11 is positioned to the positioning hole 103 of the side board 101. A top surface of the base 11 is provided with a longitudinal press board 13. The press board 13 has a second curved surface 131 relative to the first end 116 of the base 11. The top surface of the base 11 is provided with a reverse folding member 14. A passage P is defined between the press board 13 and the reverse folding member 14. One side of the reverse folding member 14 has an inclined surface 141 relative to the passage P. In this embodiment of the present invention, the reverse folding member 14 comprises a longitudinal reverse folding block 14*a* and a longitudinal reverse folding reinforcement block 14*b*. The passage P is formed between the press board 13 and the reverse folding block 14*a*. One side of the reverse folding block 14*a* has a first inclined surface 141*a* relative to the passage P. The base 11 is provided with a longitudinal reverse folding reinforcement block 14*b* at one side of the reverse folding block 14*a* relative to the second end 117. One side of the reverse folding reinforcement block 14*b* has a second inclined surface 141*b* relative to the passage P. The second inclined surface 141*b* is parallel to the first inclined surface 141*a*. The second inclined surface 141*b* slightly protrudes out of the first inclined surface 141*a*, such that the reverse folding reinforcement block 14*b* is formed with a protruding portion 142*b*. The reverse folding reinforcement block 14*b* has an upper top surface 143*b* at one end of the second inclined surface 141*b* close to the press board 13. The upper top surface 143*b* is perpendicular to the base 11. The base 11 is provided with a longitudinal flattening board 16 close to the second end 117. The flattening board 16 is substantially perpendicular to the press board 13. The flattening board 16 extends beyond an extension plane 143 *c* of the upper top surface 143*b*, such that a distance d is defined between an end portion of the flattening board 16 and the extension plane of the upper top surface 143*b*. The end portion of the flattening board 16 has a third curved surface 161. The flattening board 16 has a bevel 163 at a top end of the third curved surface 161. In this embodiment, the edge folding block 10 is integrally formed.

Figure 8:
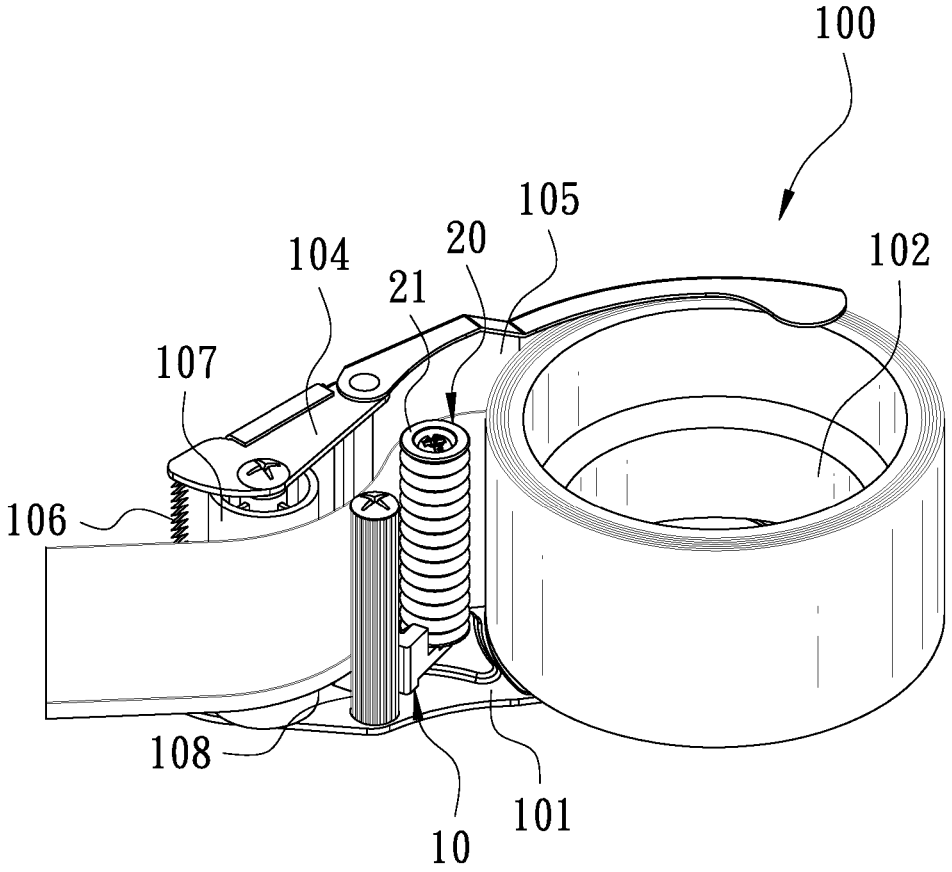
FIG. 8 is a schematic view of the present invention when in use.
Figure 9:
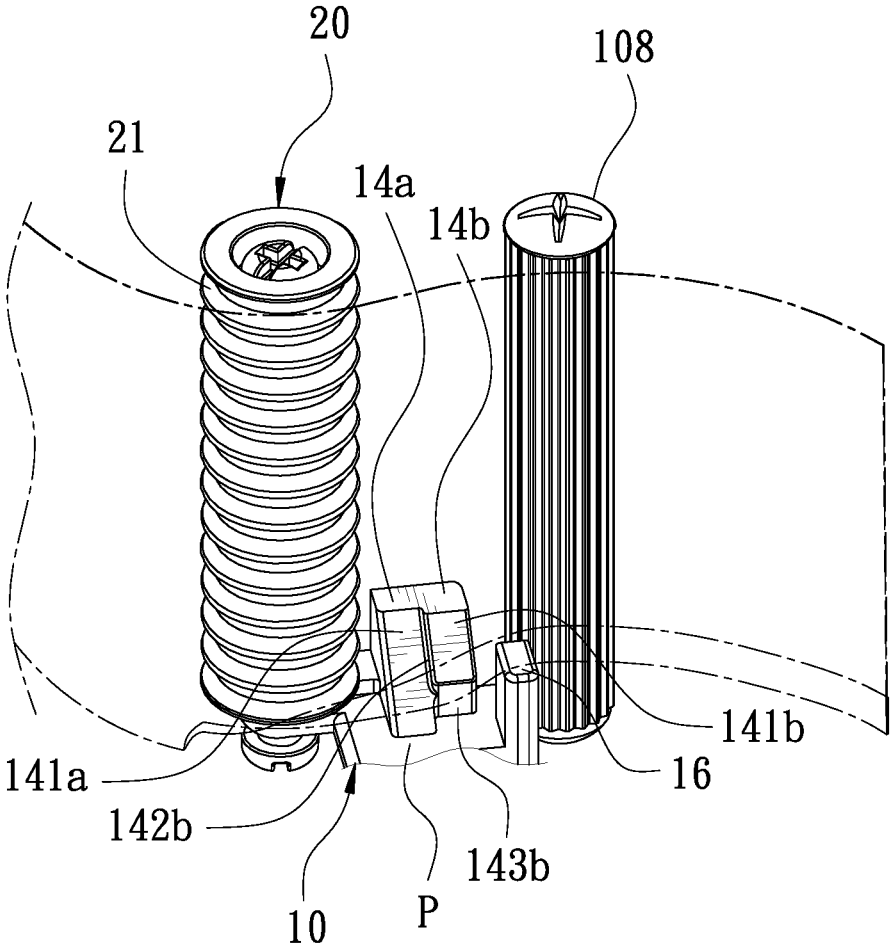
FIG. 9 is a partial enlarged view of the present invention when in use.
Figure 10:
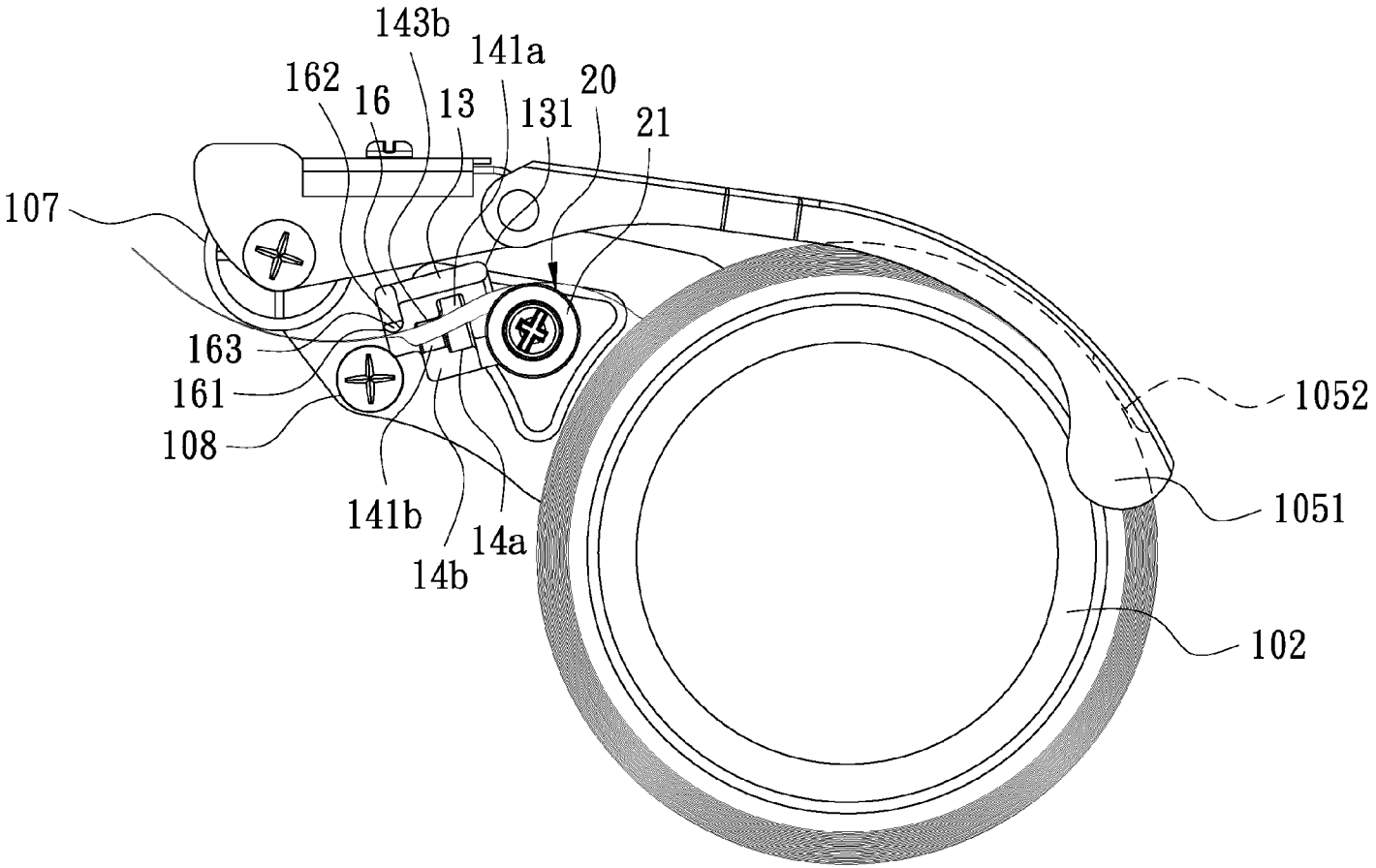
FIG. 10 is a top view of the present invention when in use, showing the tape not in a pulled state.
Figure 11:
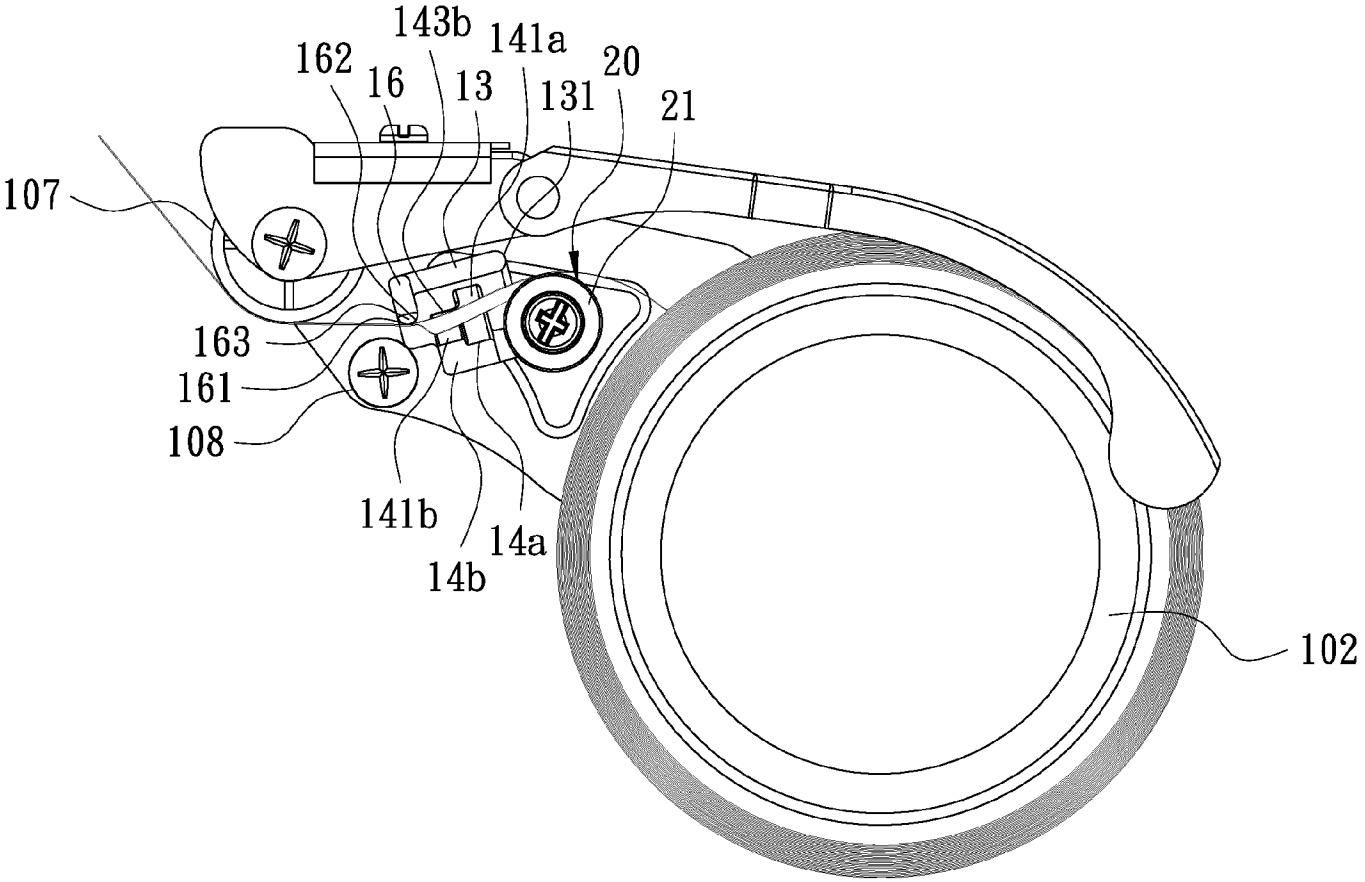
FIG. 11 is a top view of the present invention when in use, showing the tape in a pulled state.

FIG. 8 is a schematic view of the present invention when in use. FIG. 9 is a partial enlarged view of the present invention when in use. FIG. 10 is a top view of the present invention when in use, showing the tape not in a pulled state. FIG. 11 is a top view of the present invention when in use, showing the tape in a pulled state. When the present invention is used, the tape on the tape seat 102 is pulled. The tape is first in contact with the folding post 20 and stressed by contacting the folding post 20, enabling the side edge of the tape to fall into the gap, and then the tape passes the first curved surface 118 to enter the passage P. The tape is pressed down by the second curved surface 131 of the press board 13, preventing the side edge of the tape from not being folded totally. Afterward, when the tape passes the first inclined surface 141*a* of the reverse folding block 14*a*, the inner side edge of the tape is folded to pass the upper top surface 143*b* of the reverse folding reinforcement block 14*b* to reinforce the reverse folding effect. This moment, the tape is reversely folded almost fully. In cooperation with the pulling force of the tape, the tape is reversely folded fully under stress so as to form a folded side edge. Finally, the tape passes the flattening board 16. Through the distance d between the flattening board 16 and the reverse folding reinforcement block 14*b*, the reverse folded tape can be flattened to form a strip of nonstick folded side edge. Thereby, when the tape is taped to a packing, the tape is formed with a strip of nonstick folded side edge. When the user wants to tear off the tape, the nonstick folded side edge is lifted to tear off the tape quickly. The operation is convenient and quick.

It is noted that the free end of the top lid 105 is formed with the recesses 1052. When the tape is used, the recesses 1052 apply a force to the tape directly, providing an effect to adjust the tension of the tape.

Furthermore, the stop piece 1051 of the top lid 105 prevents the tape roll from falling off when the top lid 105 is not applied with a force.

It is further noted that the gap formed between the bottom surface of the folding post 20 and the side board 101 through the raised block 18 enables the tape to fall down under stress when the tape passes the folding post 20. The tape is folded and falls into the gap. In the meanwhile, the tape is pressed down by the second curved surface 131 of the press board 13, preventing the side edge of the tape from not being folded totally when the tape passes the edge folding block 10. Afterward, the tape passes the first inclined surface 141*a* of the reverse folding block 14*a* to enter the passage P, in particular to the entrance of the passage formed by the first inclined surface 141*a* of the reverse folding block 14*a* and the second curved surface 131 of the press board 13.

It is further noted that the folded side edge means that when the tape passes the first inclined surface 141 *a* of the reverse folding block 14*a*, the inner side edge of the tape is folded reversely and then to pass the upper top surface 143*b* of the reverse folding reinforcement block 14*b*. Wherein, the first inclined surface 141*a* is parallel to the second inclined surface 141*b*. Through the reverse folding reinforcement effect, the tape is reversely folded almost fully. In cooperation with the pulling force of the tape, the tape is reversely folded fully under stress.

It is further noted that the flatting means that the distance d between the flattening board 16 and the reverse folding reinforcement block 14*b* in cooperation with the pulling force of the tape enables the flattening board 16 and the reverse folding reinforcement block 14*b* to generate a respective counterforce in the direction of the passage. Wherein, the reverse folding reinforcement block 14*b* generates a counterforce through the second inclined surface 141*b*, the upper top surface 143*b* or a combination thereof, such that the reverse folded tape can be flattened in the way of stagger.

It is noted that the distance d formed at the end portion of the flattening board 16 is only an embodiment of the present invention. The end portion of the flattening board 16 can be understood to hold against the tape and generate a counterforce to flatten the tape during the tape is pulled for use.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A tape applicator having an edge folding structure, comprising:

a main body, the main body having a side board at one end thereof, the side board being provided with a blade, a press roller, and a tape seat;

an edge folding block, the edge folding block comprising a base, the base having a first end and a second end positioned to the side board, the base being pivotally connected with a folding post adjacent to the first end of the base, a gap being defined between a bottom surface of the folding post and the side board, a top surface of the base being provided with a press board and a reverse folding member, a passage being defined between the press board and the reverse folding member, one side of the reverse folding member having an inclined surface relative to the passage, the base being provided with a flattening board adjacent to the second end of the base, the flatting board having an end portion extending towards the passage;

thereby, through a pulling force of a tape when the tape is applied, a side edge of the tape falling into the gap and being reversely folded when the tape passes the reverse folding member, and then the tape being flattened by the end portion of the flattening board to form a folded side edge; and the reverse folding member comprising a reverse folding block relative to the first end, the passage being formed between the press board and the reverse folding block, one side of the reverse folding block having a first inclined surface relative to the passage;

the reverse folding member further comprising a reverse folding reinforcement block connected to the reverse folding block relative to the second end, the passage being formed further between the press board and the reverse folding reinforcement block, one side of the reverse folding reinforcement block having a second inclined surface relative to the passage;

the second inclined surface being parallel to the first inclined surface;

the second inclined surface protruding out of the first inclined surface, such that the reverse folding reinforcement block is formed with a protruding portion; and the inclined surface comprising the first inclined surface and the second inclined surface.

2. The tape applicator having an edge folding structure as claimed in claim 1, wherein the reverse folding reinforcement block has an upper top surface at one end of the second inclined surface adjacent to the press board, and the upper top surface is perpendicular to the base.

3. The tape applicator having an edge folding structure as claimed in claim 2, wherein the flattening board is substantially perpendicular to the press board, and the flattening board extends beyond an extension plane of the upper top surface, such that a distance is defined between the end portion of the flattening board and the extension plane of the upper top surface.

4. The tape applicator having an edge folding structure as claimed in claim 1, wherein the side board is provided with a positioning hole, the first end of the base has another positioning hole, the base is provided with a raised block at one side of the positioning hole of the base, the side board is pivotally connected with the folding post through the positioning hole of the base, a bottom surface of the second end of the base is provided with a positioning protrusion relative to the positioning hole of the side board, and the base is positioned to the positioning hole of the side board through the positioning protrusion.

5. The tape applicator having an edge folding structure as claimed in claim 4, wherein a circumferential wall of the folding post is provided with a plurality of serrate raised portions, and the serrate raised portions are placed on a top surface of the raised block.

6. The tape applicator having an edge folding structure as claimed in claim 4, wherein one side of the base has a first curved surface adjacent to the positioning hole of the base, the press board has a second curved surface adjacent to the first end of the base, and the end portion of the flattening board has a third curved surface.

7. The tape applicator having an edge folding structure as claimed in claim 6, wherein the flattening board has a bevel at a top end of the third curved surface.

* * * * *